US008469505B2

(12) United States Patent
Ohba et al.

(10) Patent No.: US 8,469,505 B2
(45) Date of Patent: Jun. 25, 2013

(54) INKJET RECORDING APPARATUS AND THERMAL INSULATION METHOD

(75) Inventors: Masahiro Ohba, Kanagawa-ken (JP); Nobuaki Yoneyama, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 139 days.

(21) Appl. No.: 13/074,677

(22) Filed: Mar. 29, 2011

(65) Prior Publication Data

US 2011/0242244 A1 Oct. 6, 2011

(30) Foreign Application Priority Data

Mar. 30, 2010 (JP) ..... 2010-078139

(51) Int. Cl.
*B41J 2/01* (2006.01)

(52) U.S. Cl.
USPC ..... 347/102; 347/101

(58) Field of Classification Search
USPC ..... 347/101, 102, 103
See application file for complete search history.

(56) References Cited

U.S. PATENT DOCUMENTS

| | | | | |
|---|---|---|---|---|
| 4,693,588 | A * | 9/1987 | Yarbrough et al. | 399/93 |
| 2010/0225695 | A1* | 9/2010 | Fujikura | 347/16 |
| 2011/0069104 | A1* | 3/2011 | Tsuzawa | 347/17 |
| 2011/0205321 | A1* | 8/2011 | Kobayashi et al. | 347/102 |

FOREIGN PATENT DOCUMENTS

JP 2006-69739 A 3/2006

* cited by examiner

*Primary Examiner* — Julian Huffman
*Assistant Examiner* — Sharon A Polk
(74) *Attorney, Agent, or Firm* — Birch, Stewart, Kolasch & Birch, LLP

(57) ABSTRACT

An inkjet recording apparatus includes: an image formation unit including an inkjet head which forms an image on a recording medium, and an image formation drum which rotates while supporting the recording medium on a circumferential surface and thereby moves the recording medium relatively to the inkjet head; a drying process unit including a drying process device which performs a drying process on the recording medium on which the image has been formed by the inkjet head, and a drying drum which rotates while supporting the recording medium on a circumferential surface and thereby moves the recording medium in a process region of the drying process unit; and an air curtain generation unit which generates an air flow in a downward direction between the image formation unit and the drying process unit, and thereby generates an air curtain for thermal insulation between the image formation unit and the drying process unit.

10 Claims, 10 Drawing Sheets

INKJET RECORDING APPARATUS AND THERMAL INSULATION METHOD

BACKGROUND OF THE INVENTION

1. Field of the Invention

The present invention relates to an inkjet recording apparatus and a thermal insulation method, more particularly to thermal insulation technology for stabilizing the ambient temperature around an inkjet head.

2. Description of the Related Art

An inkjet recording apparatus for forming a desired image on a recording medium by using an inkjet method is known as a general-purpose image recording apparatus. It is necessary for achieving good performance of the inkjet recording apparatus to create an environment where an inkjet head is allowed to stably eject and deposit ink droplets onto a recording medium, and also to shortly dry the ink droplets deposited on the recording medium. For example, it is important to keep the temperature around the inkjet head constant in order to realize the environment where the stable ink droplet ejection operation is performed. On the other hand, in order to dry the ink in a short time, it is effective to perform a heating process immediately after the ink droplet deposition operation.

In order to speed up the process of drying the ink on the recording medium after the ink droplet deposition operation, it is preferred to bring the inkjet head close to a drying process unit, so that the drying process can be started immediately after the deposition of the ink droplets. In this case, the inkjet head that needs to keep its temperature (e.g., 30° C.) lower than the drying process temperature, which is approximately 60° C. to 80° C., is brought close the drying process unit that needs to keep its temperature high as mentioned above, in order to improve its drying performance.

On the other hand, it is desirable that the inkjet head and the drying process unit are kept away from each other as far as possible in order to maintain the relatively low temperature of the inkjet head and the relatively high temperature of the drying process unit; however, this makes it difficult to realize the efficient drying process described above.

In other words, various kinds of efforts need to be made in order to simultaneously realize the conflicting environments, i.e., the relatively low temperature around the inkjet head and the relatively high temperature of the drying process unit. The configuration of an inkjet recording apparatus in the related art has a cooling device that performs a cooling process on the inkjet head, wherein the cooling device forcibly cools the inkjet head.

However, when the inkjet recording apparatus is provided with the cooling device for cooling the inkjet head and the periphery thereof, because the ambient temperature of the inkjet head is raised by the heat generated by the drying process unit due to the close arrangement between the inkjet head and the drying process unit, the size of the entire apparatus increases, as well as the consumption power in the entire apparatus. Moreover, when the ambient temperature of the inkjet head exceeds a predetermined temperature, it causes troubles such as condensation on a nozzle surface of the inkjet head and a sensor failure to detect floating of a sheet of recording medium. Therefore, additional parts are required for coping with such troubles; which requires a space large enough to arrange these additional parts in the entire apparatus, leading to an increase in the costs.

Although it is considered to arrange a member having thermal insulating properties at a position between the inkjet head and the drying process unit to insulate the inkjet head from the heat generated by the drying process unit, this requires the space for disposing the thermal insulation member, and disposing the thermal insulation member on a path for conveying a recording medium not only requires the space but also creates various barriers.

Japanese Patent Application Publication No. 2006-069739 discloses a recording apparatus in which an air curtain is disposed between a print unit and a paper feed unit located in an upstream side of the print unit, and a space of the upstream side of the print unit is thereby separated from a space of the print unit. However, this recording apparatus is provided with the air curtain to prevent the entry of foreign matter into the periphery of the print unit, but has no configuration for insulating the print unit from heat generated by other process units. Furthermore, Japanese Patent Application Publication No. 2006-069739 does not focus on the impacts of the heat on the print unit, the heat being generated as a result of the drying process, and is silent about technology for solving the problems associated with the impacts of the heat.

SUMMARY OF THE INVENTION

The present invention has been contrived in view of these circumstances, an object thereof being to provide an inkjet recording apparatus and thermal insulation method that are capable of not only improving efficiency of a drying process performed after image formation, but also realizing a preferred ink droplet ejection operation by preventing the impacts of heat on an image formation unit, the heat being generated as a result of the drying process.

In order to attain the aforementioned object, the present invention is directed to an inkjet recording apparatus, comprising: an image formation unit including: an inkjet head which forms an image on a recording medium; and an image formation drum which has a cylindrical shape, rotates on a central axis of the cylindrical shape serving as a rotational axis while supporting the recording medium on a circumferential surface of the image formation drum, and thereby moves the recording medium along a circumferential direction of the image formation drum relatively to the inkjet head; a drying process unit including: a drying process device which performs a drying process on the recording medium on which the image has been formed by the inkjet head; and a drying drum which has a cylindrical shape, rotates on a central axis of the cylindrical shape serving as a rotational axis while supporting the recording medium on a circumferential surface of the drying drum, and thereby moves the recording medium along a circumferential direction of the drying drum in a process region of the drying process unit; and an air curtain generation unit which generates, between the image formation unit and the drying process unit, an air flow in one of a vertically downward direction and a downward direction oblique to a vertical direction, and thereby generates an air curtain for thermal insulation between the image formation unit and the drying process unit.

According to this aspect of the present invention, the air curtain for thermally insulating the image formation unit and the drying process unit from each other is generated by the air flow generated between the image formation unit and the drying process unit. Therefore, the impacts of the heat on the image formation unit can be suppressed, the heat being generated as a result of the drying process of the drying unit. Moreover, the ambient temperature around the image formation unit can be kept within a predetermined range, so that an excellent image formation environment can be maintained. Furthermore, the conventional cooler for cooling an image formation unit (particularly an inkjet head) and its periphery can be eliminated or reduced in size; which contributes to reduction in size of the entire apparatus of the present invention, as well as to reduction in power consumption in the entire apparatus of the present invention.

The term "air curtain" means an air curtain that is configured by an air flow blown in a planar shape in a certain direction at a predetermined air flow speed. This air curtain fulfills an insulation function equivalent to a physical thermal insulation member, and blocks a flow of air between the drying process unit and the image formation unit.

Preferably, the drying process unit further includes: a transfer drum which transfers the recording medium having the image formed thereon from the image formation drum to the drying drum; and a guide member which is arranged in a proximal position under the transfer drum, supports the recording medium which is being conveyed by the transfer drum, and performs the drying process on the recording medium which is being conveyed by the transfer drum; and the air curtain generation unit generates the air flow between the image formation unit and the transfer drum.

For example, the guide member can be provided with a built-in heater.

Preferably, the drying process unit further includes: a transfer drum which transfers the recording medium having the image formed thereon from the image formation drum to the drying drum; and a guide member which is arranged in a proximal position under the transfer drum, supports the recording medium which is being conveyed by the transfer drum, and performs the drying process on the recording medium which is being conveyed by the transfer drum; and the air curtain generation unit generates the air flow between the image formation unit and the transfer drum.

According to this aspect of the present invention, generating the air curtain between the image formation unit and the transfer drum can thermally insulate the image formation unit from the heat generated from the drying process, even when the drying process is also performed using the transfer drum that transfers the recording medium from the image formation drum to the drying drum.

Preferably, the air curtain generation unit includes: an air flow generation device which generates an air flow in one of a vertically downward direction and a downward direction oblique to the vertical direction; and a restricting unit which includes: an inlet through which the air flow generated by the air flow generation device enters the restricting unit; and a discharge side opening through which the air flow exits from the restricting unit to generate the air curtain, the discharge side opening having an aperture area smaller than an aperture area of the inlet, the discharge side opening having a length, in a direction parallel to an axial direction of the image formation drum, corresponding to an entire length of the image formation unit in a direction parallel to the axial direction of the image formation drum.

According to this aspect of the present invention, restricting the air flow generated by the air flow generation device can increase the air flow speed, thereby forming a more preferred air curtain.

The restricting unit according to this aspect preferably increases the speed of the air flow generated by the air flow generation device, by at least threefold.

Examples of the air flow generation device according to this aspect include a fan motor. A plurality of the fan motors can be disposed along a lengthwise direction of the inlet of the restricting unit.

Preferably, the air curtain generation unit further includes: a suction side opening through which air is sucked into the air curtain generation unit, the suction side opening being arranged on a side face of the air curtain generation unit facing the image formation unit; and a filter which is arranged between the suction side opening and the air flow generation device.

According to this aspect of the present invention, the air curtain generation device can also serve as a device for recovering ink mist floating around the image formation unit. A combination of the air curtain generation device and the recovery device can contribute to reduction in size of the apparatus and provide a function for generating an additional air curtain while keeping the function for recovering the ink mist.

Preferably, the suction side opening is arranged at one of an upper end and a lower end of the side face of the air curtain generation unit facing the image formation unit.

In this aspect of the present invention, the suction side opening is preferably arranged at the upper end of the side face of the air curtain generation unit facing the image formation unit.

Preferably, the side face of the air curtain generation unit facing the image formation unit is inclined toward the image formation drum to follow a shape of the image formation drum.

According to this aspect of the present invention, the air curtain generation device and the image formation drum can be disposed adjacent to each other, and improvement of ink mist recovery efficiency is expected.

It is also preferable that the side face of the air curtain generation unit facing the image formation unit has a partially-cylindrical shape to follow the shape of the image formation drum.

Preferably, the air curtain generation unit has a flange portion which protrudes from the suction side opening toward the image formation drum.

According to this aspect of the present invention, the ink mist can be easily guided to the suction side opening, and improvement of ink mist recovery efficiency is expected.

Preferably, a breadth of the suction side opening in a direction perpendicular to the axial direction of the image formation drum is not shorter than 10 mm and not longer than 30 mm.

According to this aspect of the present invention, the air flow speed at the suction side opening can be set at 1.5 m/sec or above, and the air flow speed at the discharge side opening can be set at 4.5 m/sec or above. Accordingly, a preferred air curtain can be generated.

It is more preferable that the breadth of the suction side opening is not shorter than 12.5 mm.

Preferably, a breadth of the discharge side opening in a direction perpendicular to the axial direction of the image formation drum is not shorter than 10 mm and not longer than 30 mm.

According to this aspect, the conditions of the air flow speed at the suction side opening and the air flow speed at the discharge side opening can be satisfied regardless of the position and shape of the suction side opening.

It is more preferable that the breadth of the discharge side opening is not longer than 14 mm.

In order to attain the aforementioned object, the present invention is also directed to a method of thermally insulating an image formation unit and a drying process unit in an inkjet recording apparatus from each other, wherein: the inkjet recording apparatus comprises: the image formation unit including: an inkjet head which forms an image on a recording medium; and an image formation drum which has a cylindrical shape, rotates on a central axis of the cylindrical shape serving as a rotational axis while supporting the recording medium on a circumferential surface of the image formation drum, and thereby moves the recording medium along a circumferential direction of the image formation drum relatively to the inkjet head; the drying process unit including: a drying process device which performs a drying process on the recording medium on which the image has been formed by the inkjet head; and a drying drum which has a cylindrical shape, rotates on a central axis of the cylindrical shape serving as a rotational axis while supporting the recording medium on a circumferential surface of the drying drum, and thereby moves the recording medium along a circumferential direction of the drying drum in a process region of the drying process unit, and the method comprises the steps of: generating an air flow between the image formation unit and the drying process unit; and thereby generating an air curtain for thermal insulation between the image formation unit and the drying process unit.

According to the present invention, an airflow that is generated between the image formation unit and the drying process unit generates an air curtain to thermally insulate the image formation unit and the drying process unit from each other. Thus, the impacts of the heat on the image formation unit can be prevented, the heat being generated as a result of a drying process performed by the drying process unit, and accordingly a preferred image formation environment can be maintained because the ambient temperature of the image formation unit is kept within a predetermined range. Moreover, the conventional cooler for cooling the image formation unit (particularly the inkjet head) and its periphery can be reduced in size or eliminated; which contributes to reduction in size of the entire apparatus of the present invention, as well as to reduction in power consumption in the entire apparatus of the present invention.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

<General Composition of Inkjet Recording Apparatus>

Figure 1:
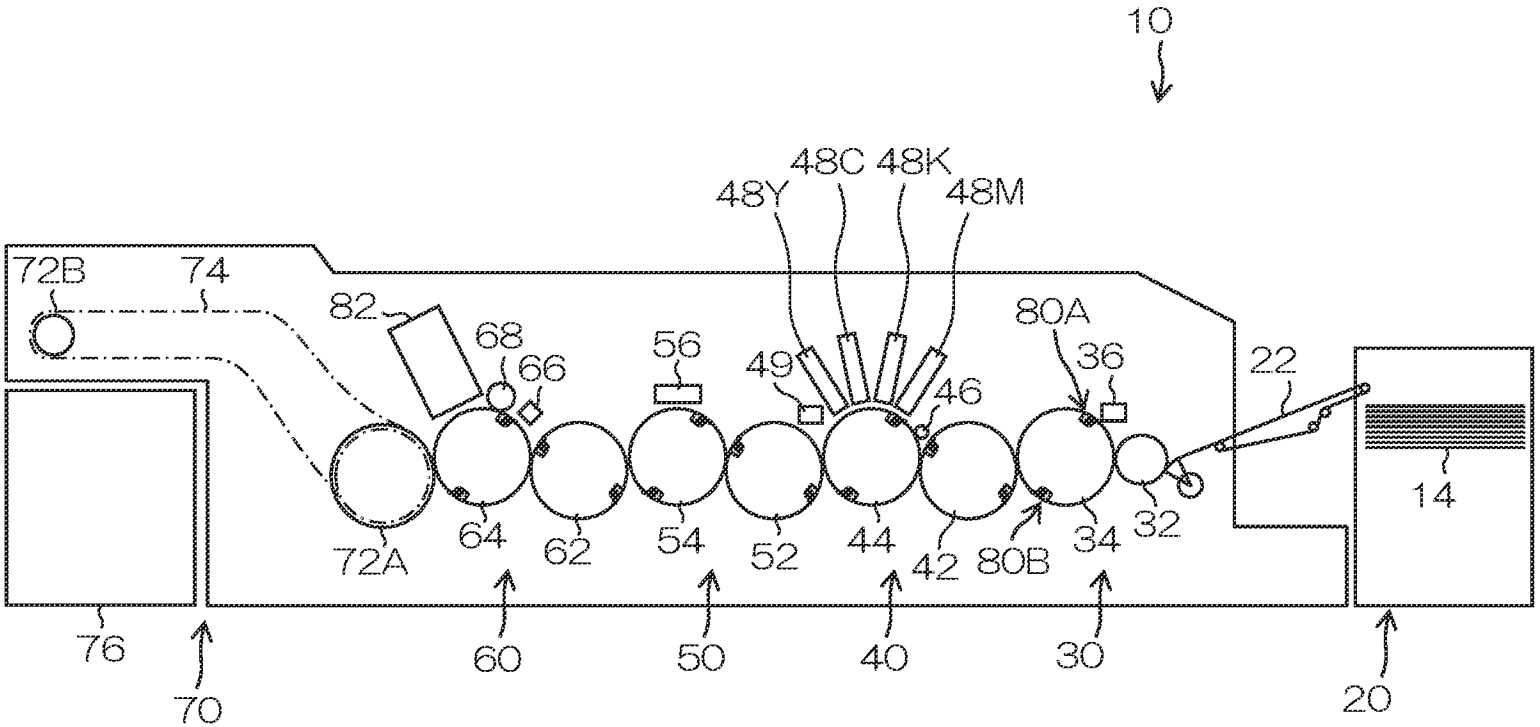
FIG. 1 is an entire configuration diagram of an inkjet recording apparatus according to an embodiment of the present invention.

FIG. 1 is a schematic drawing showing the general composition of an inkjet recording apparatus according to an embodiment of the present invention. The inkjet recording apparatus 10 shown in FIG. 1 is an on-demand type recording apparatus based on a two-liquid aggregation system which forms an image on a recording surface of a recording medium 14 on the basis of prescribed image data, by using ink containing coloring material and an aggregating treatment liquid having a function of aggregating the ink.

The inkjet recording apparatus 10 includes a paper feed unit 20, the treatment liquid application unit 30, an image formation unit 40, a drying process unit 50, a fixing process unit 60, and an output unit 70. Transfer drums 32, 42, 52 and 62 are arranged as devices which receive and transfer the recording medium 14 conveyed respectively from stages prior to the treatment liquid application unit 30, the image formation unit 40, the drying process unit 50, and the fixing process unit 60. Pressure drums 34, 44, 54 and 64 having a cylindrical shape are arranged as devices for holding and conveying the recording medium 14 respectively in the treatment liquid application unit 30, the image formation unit 40, the drying process unit 50, and the fixing process unit 60.

Each of the pressure drums 34, 44, 54 and 64 and the transfer drums 32, 42, 52 and 62 is coupled to a motor (not shown) through a transmission mechanism (not shown), and is rotated at a predetermined rotational speed in a predetermined rotational direction around a cylindrical central axis by the operation of the motor. Furthermore, a guide member (not shown) for supporting the recording medium 14 that is being conveyed is arranged under each of the transfer drums 32, 42, 52 and 62.

Each of the transfer drums 32, 42, 52 and 62 and the pressure drums 34, 44, 54 and 64 is provided with grippers 80A and 80B, which grip and hold the leading end portion (or the trailing end portion) of the recording medium 14. The gripper 80A and the gripper 80B adopt a common structure for gripping and holding the leading end portion of the recording medium 14 and for transferring the recording medium 14 with respect to the gripper arranged in another pressure drum or transfer drum; furthermore, the gripper 80A and the gripper 80B are disposed in symmetrical positions separated by 180° in the direction of rotation of each drum on the outer circumferential surface of each drum.

When the transfer drums 32, 42, 52, and 62 and the pressure drums 34, 44, 54 and 64 which have gripped the leading end portion of the recording medium 14 by means of the grippers 80A and 80B rotate in a prescribed rotational direction, the recording medium 14 is rotated and conveyed following the outer circumferential surface of the transfer drums 32, 42, 52 and 62 and the pressure drums 34, 44, 54 and 64. In FIG. 1, only the reference numerals of the grippers 80A and 80B arranged on the pressure drum 34 are indicated, and the reference numerals of the grippers on the other pressure drums and transfer drums are not shown.

When the recording medium (e.g., a cut sheet of paper) 14 accommodated in a paper feed unit 20 is supplied to the treatment liquid application unit 30, the aggregating treatment liquid (hereinafter referred to simply as "treatment liquid") is applied to the recording surface of the recording medium 14 held on the outer circumferential surface of the pressure drum 34. The "recording surface of the recording medium 14" is the outer surface when the recording medium 14 is held by the pressure drums 34, 44, 54 and 64, this being reverse to the surface held on the pressure drums 34, 44, 54 and 64.

Thereupon, the recording medium 14 on which the aggregating treatment liquid has been applied is output to the image formation unit 40 and colored inks are deposited by the image formation unit 40 onto the area of the recording surface where the aggregating treatment liquid has been applied, thereby forming a desired image.

Moreover, the recording medium 14 on which the image has been formed by the colored inks is sent to the drying process unit 50, and a drying process is carried out by the drying process unit 50. After the drying process, the recording medium 14 is conveyed to the fixing process unit 60, and a fixing process is carried out. By carrying out the drying process and the fixing process, the image formed on the recording medium 14 is made durable. In this way, the desired image is formed on the recording surface of the recording medium 14 and after fixing the image on the recording surface of the recording medium 14, the recording medium 14 is conveyed to the exterior of the inkjet recording apparatus through the output unit 70.

The respective units of the inkjet recording apparatus 10 (paper feed unit 20, treatment liquid application unit 30, image formation unit 40, drying process unit 50, fixing process unit 60 and output unit 70) are described in detail below.

<Paper Feed Unit>

The paper feed unit 20 includes a paper feed tray 22 and a paying out mechanism (not shown), and is composed so as to pay out the recording medium 14 one sheet at a time from the paper feed tray 22. The recording medium 14 paid out from the paper feed tray 22 is registered in position by a guide member (not shown) and halted temporarily in such a manner that the leading end portion is disposed at the position of the gripper (not shown) on the transfer drum (paper feed drum) 32.

<Treatment Liquid Application Unit>

The treatment liquid application unit 30 includes: the pressure drum (treatment liquid drum) 34, which holds, on the outer circumferential surface thereof, the recording medium 14 transferred from the paper feed drum 32 and conveys the recording medium 14 in the prescribed conveyance direction; and a treatment liquid application device 36, which applies the treatment liquid to the recording surface of the recording medium 14 held on the outer circumferential surface of the treatment liquid drum 34. When the treatment liquid drum 34 is rotated in the counter-clockwise direction in FIG. 1, the recording medium 14 is conveyed so as to rotate in the counter-clockwise direction following the outer circumferential surface of the treatment liquid drum 34.

The treatment liquid application device 36 shown in FIG. 1 is arranged at a position facing the outer circumferential surface (recording medium holding surface) of the treatment liquid drum 34. One example of the composition of the treatment liquid application device 36 is a mode which includes: a treatment liquid vessel, which stores the treatment liquid; an uptake roller (an anilox roller), which is partially immersed in the treatment liquid in the treatment liquid vessel and takes up the treatment liquid from the treatment liquid vessel; and an application roller, which moves the treatment liquid taken up by the uptake roller onto the recording medium 14.

A desirable mode is one which includes an application roller movement mechanism, which moves the application roller in the upward and downward direction (the normal direction with respect to the outer circumferential surface of the treatment liquid drum 34), so as to be able to avoid collisions between the application roller and the grippers 80A and 80B.

The treatment liquid applied on the recording medium 14 by the treatment liquid application unit 30 contains a coloring material aggregating agent, which aggregates the coloring material (pigment) in the ink to be deposited by the image formation unit 40, and when the treatment liquid and the ink come into contact with each other on the recording medium 14, the separation of the coloring material and the solvent in the ink is promoted.

It is desirable that the treatment liquid application device 36 doses the amount of treatment liquid applied to the recording medium 14 while applying the treatment liquid, and that the thickness of the film of treatment liquid on the recording medium 14 is sufficiently smaller than the diameter of the ink droplets which are ejected from the image formation unit 40.

<Image Formation Unit>

The image formation unit 40 includes: the pressure drum (image formation drum) 44, which holds and conveys the recording medium 14; a paper pressing roller 46 for causing the recording medium 14 to adhere tightly to the image formation drum 44; and inkjet heads 48M, 48K, 48C and 48Y, which deposit the inks onto the recording medium 14. The basic structure of the image formation drum 44 is common to that of the treatment liquid drum 34, which is described previously, and therefore the description of it is omitted here. The grippers of the image formation drum 44 are arranged inside the image formation drum 44 at sections inward from its circumferential surface so that the grippers do not project from the circumferential surface. The leading end portion of the recording medium 14 enters inside the section inward from the circumferential surface and gripped with the grippers.

The paper pressing roller 46 is a guide member for causing the recording medium 14 to make tight contact with the outer circumferential surface of the image formation drum 44, and is disposed facing the outer circumferential surface of the image formation drum 44, to the downstream side, in terms of the conveyance direction of the recording medium 14, of the transfer position of the recording medium 14 between the transfer drum 42 and the image formation drum 44 and to the upstream side, in terms of the conveyance direction of the recording medium 14, of the inkjet heads 48M, 48K, 48C and 48Y.

When the recording medium 14 that has been transferred from the transfer drum 42 to the image formation drum 44 is conveyed to rotate in a state where the leading end is held by the grippers (not denoted with reference numeral), the recording medium 14 is pressed by the paper pressing roller 46 and is caused to make tight contact with the outer circumferential surface of the image formation drum 44. After the recording medium 14 has been caused to make tight contact with the outer circumferential surface of the image formation drum 44 in this way, the recording medium 14 is passed to a printing region directly below the inkjet heads 48M, 48K, 48C and 48Y, without any floating up of the recording medium 14 from the outer circumferential surface of the image formation drum 44.

The outer circumferential surface of the image formation drum 44 is provided with a plurality of suction holes (not shown). The suction holes are communicated with a vacuum flow channel (not shown) arranged inside the image formation drum 44, and the vacuum flow channel is connected with a pump (not shown). The pump is operated to generate negative pressure in the suction holes through the vacuum flow channel, whereby the recording medium 14 is held to the outer circumferential surface of the image formation drum 44 by suction.

The inkjet heads 48M, 48K, 48C and 48Y respectively correspond to the inks of the four colors of magenta (M), black (K), cyan (C) and yellow (Y), and are disposed in this order from the upstream side in terms of the direction of rotation of the image formation drum 44 (the counter-clockwise direction in FIG. 1), and ink ejection surfaces or nozzle surfaces 114A (see FIG. 4) of the inkjet heads 48M, 48K, 48C and 48Y are disposed so as to face the recording surface of the recording medium 14 that is held on the image formation drum 44. Here, the "ink ejection surfaces (nozzle surfaces)" are surfaces of the inkjet heads 48M, 48K, 48C and 48Y which face the recording surface of the recording medium 14, and are the surfaces where apertures 108 (see FIG. 3) of the nozzles which eject the inks as described below are formed.

Each of the inkjet heads 48M, 48K, 48C and 48Y shown in FIG. 1 is disposed at an inclination with respect to the horizontal plane in such a manner that the nozzle surface of each of the inkjet heads 48M, 48K, 48C and 48M is substantially parallel to the recording surface of the recording medium 14 that is held on the outer circumferential surface of the image formation drum 44.

The inkjet heads 48M, 48K, 48C and 48Y are full line heads having a length corresponding to the maximum width of the image forming region on the recording medium 14 (the dimension of the recording medium 14 in the direction perpendicular to the conveyance direction), and are fixed so as to extend in a direction perpendicular to the conveyance direction of the recording medium 14.

The nozzles for ejecting the inks are formed in a matrix configuration on the nozzle surfaces of the inkjet heads 48M, 48K, 48C and 48Y throughout the whole width of the image forming region of the recording medium 14.

When the recording medium 14 is conveyed to the printing region directly below the inkjet heads 48M, 48K, 48C and 48Y, droplets of the inks of respective colors are ejected from the inkjet heads 48M, 48K, 48C and 48Y on the basis of image data, and are deposited onto the region of the recording medium 14 where the aggregating treatment liquid has been applied.

When the droplets of the colored inks are deposited from the corresponding inkjet heads 48M, 48K, 48C and 48Y onto the recording surface of the recording medium 14 held on the outer circumferential surface of the image formation drum 44, the inks make contact with the treatment liquid on the recording medium 14, and an aggregating reaction occurs with coloring material (pigment-based coloring material) that is dispersed in the inks or coloring material (dye-based coloring material) that can be insolubilized, thereby forming an aggregate of the coloring material. Thus, movement of the coloring material in the image formed on the recording medium 14 (namely, positional displacement of the dots, color non-uniformities of the dots) is prevented.

Furthermore, the image formation drum 44 of the image formation unit 40 is structurally separate from the treatment liquid drum 34 of the treatment liquid application unit 30, and therefore the treatment liquid is never applied to the inkjet heads 48M, 48K, 48C and 48Y, and it is possible to reduce the causes of ink ejection abnormalities.

Although a configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

An air curtain generation unit 49 for generating an air curtain (not shown) between the image formation unit 40 and the drying process unit 50 is arranged on the downstream side of the inkjet heads 48M, 48K, 48C and 48Y in terms of the direction of conveyance of the recording medium. As will be described hereinafter in detail, the air curtain that is arranged between the image formation unit 40 and the drying process unit 50 by the air curtain generation unit 49 forms a shield to thermally insulate air flowing from the drying process unit 50 to the image formation unit 40. Accordingly, the rise in the surrounding temperature around the inkjet heads 48M, 48K, 48C and 48Y is suppressed, keeping the surrounding temperature constant.

<Drying Process Unit>

The drying process unit 50 includes: the pressure drum (drying drum) 54, which holds and conveys the recording medium 14 after image formation; and a solvent drying unit 56, which carries out a drying process for evaporating off the water content (liquid component) on the recording medium 14. The basic structure of the drying drum 54 is common to that of the treatment liquid drum 34 described previously, and therefore further description thereof is omitted here.

The solvent drying unit 56 is a processing unit which is disposed in a position facing the outer circumferential surface of the drying drum 54 and evaporates off the water content present on the recording medium 14. When the ink is deposited on the recording medium 14 by the image formation unit 40, the liquid component (solvent component) of the ink and the liquid component (solvent component) of the treatment liquid that have been separated by the aggregating reaction between the treatment liquid and the ink remain on the recording medium 14, and therefore it is necessary to remove this liquid component.

The solvent drying unit 56 carries out the drying process by evaporating off the liquid component present on the recording medium 14, through heating by a heater, or air blowing by a fan, or a combination of these, in order to remove the liquid component on the recording medium 14. The amount of heating and the air flow volume applied to the recording medium 14 are set appropriately in accordance with parameters, such as the amount of water remaining on the recording medium 14, the type of recording medium 14, the conveyance speed of the recording medium 14 (drying processing time), and the like.

When the drying process is carried out by the solvent drying unit 56, since the drying drum 54 of the drying process unit 50 is structurally separate from the image formation drum 44 of the image formation unit 40, then it is possible to reduce the causes of ink ejection abnormalities due to drying of the head meniscus portions in the inkjet heads 48M, 48K, 48C and 48Y as a result of the applied heat or air flow.

In order to display an effect in correcting cockling of the recording medium 14, the curvature of the drying drum 54 is desirably 0.002 (1/mm) or greater. Furthermore, in order to prevent curving (curling) of the recording medium after the drying process, the curvature of the drying drum 54 is desirably 0.0033 (1/mm) or less.

Moreover, desirably, a device for adjusting the surface temperature of the drying drum 54 (for example, an internal heater) may be provided to adjust the surface temperature to 50° C. or above. Drying is promoted by carrying out a heating process from the rear surface of the recording medium 14, thereby preventing destruction of the image in the subsequent fixing process. According to this mode, more beneficial effects are obtained if a device for causing the recording medium 14 to adhere tightly to the outer circumferential surface of the drying drum 54 is provided. Examples of a device for causing tight adherence of the recording medium 14 include a vacuum suction device, electrostatic attraction device or the like.

There are no particular restrictions on the upper limit of the surface temperature of the drying drum 54, but from the viewpoint of the safety of maintenance operations such as cleaning the ink adhering to the surface of the drying drum 54 (e.g., preventing burns due to high temperature), desirably, the surface temperature of the drying drum 54 is not higher than 75° C. (and more desirably, not higher than 60° C.).

By holding the recording medium 14 in such a manner that the recording surface thereof is facing outward on the outer circumferential surface of the drying drum 54 having this composition (in other words, in a state where the recording surface of the recording medium 14 is curved in a projection shape), and carrying out the drying process while conveying the recording medium 14 in rotation, it is possible reliably to prevent drying non-uniformities caused by wrinkling or floating up of the recording medium 14.

The drying process may be performed on the recording medium 14 supported by the transfer drum 52, by using the transfer drum 52 that is arranged in order to transfer the recording medium 14 from the image formation drum 44 to the drying drum 54. Examples of the drying process on the transfer drum 52 include a process of using a heater that is installed in a guide member (not shown in FIG. 1, and shown in FIG. 6 as guide members 52A and 52B) arranged under the transfer drum 52, so as to heat the recording surface of the recording medium 14 that is rotated and conveyed along the guide member, and a process of heating the recording medium 14 by means of an internal heater installed in the transfer drum <Fixing Process Unit>

The fixing process unit 60 includes: the pressure drum (fixing drum) 64, which holds and conveys the recording medium 14; a heater 66, which carries out a heating process on the recording medium 14 which the image has been formed on and the liquid has been removed from; and a fixing roller 68, which presses the recording medium 14 from the recording surface side. The basic structure of the fixing drum 64 is common to that of the treatment liquid drum 34, the image formation drum 44 and the drying drum 54, and description thereof is omitted here. The heater 66 and the fixing roller 68 are disposed in positions facing the outer circumferential surface of the fixing drum 64, and are situated in this order from the upstream side in terms of the direction of rotation of the fixing drum 64 (the counter-clockwise direction in FIG. 1).

In the fixing process unit 60, a preliminary heating process by means of the heater 66 is carried out onto the recording surface of the recording medium 14, and a fixing process by means of the fixing roller 68 is also carried out. The heating temperature of the heater 66 is set appropriately in accordance with the type of the recording medium, the type of ink (the type of polymer particles contained in the ink), and the like. For example, a possible mode is one where the heating temperature is set to the glass transition temperature or the minimum film forming temperature of the polymer particles contained in the ink.

The fixing roller 68 is a roller member for melting the self-dispersing polymer particles contained in the ink and thereby causing a state where the ink is covered with a film, by applying heat and pressure to the dried ink, and is composed so as to apply heat and pressure to the recording medium 14. More specifically, the fixing roller 68 is disposed so as to contact and press against the fixing drum 64, in such a manner that the fixing roller 68 serves as a nip roller with respect to the fixing drum 64. By this means, the recording medium 14 is held between the fixing roller 68 and the fixing drum 64 and is nipped with a prescribed nip pressure, whereby the fixing process is carried out.

An example of the composition of the fixing roller 68 is a mode where the fixing roller 68 is constituted of a heating roller which incorporates a halogen lamp inside a metal pipe made of aluminum, or the like, having good heat conductivity. If heat energy at or above the glass transition temperature of the polymer particles contained in the ink is applied by heating the recording medium 14 by means of this heating roller, then the polymer particles melt and a transparent film is formed on the surface of the image.

By applying pressure to the recording surface of the recording medium 14 in this state, the polymer particles which have incited are pressed and fixed into the undulations in the recording medium 14, and the undulations in the image surface are thereby leveled out, thus making it possible to obtain a desirable luster. A desirable composition is one where fixing rollers 68 are provided in a plurality of stages, in accordance with the thickness of the image layer and the glass transition temperature characteristics of the polymer particles.

Furthermore, desirably, the surface hardness of the fixing roller 68 is not higher than 71°. By further softening the surface of the fixing roller 68, it is possible to expect effects in following the undulations of the recording medium 14 which are produced by cockling, and fixing non-uniformities caused by the undulations of the recording medium 14 are prevented more effectively.

The inkjet recording apparatus 10 shown in FIG. 1 includes an in-line sensor 82, which is arranged at a later stage of the processing region of the fixing process unit 60 (on the downstream side in terms of the direction of conveyance of the recording medium). The in-line sensor 82 is a sensor for reading the image formed on the recording medium 14 (or a test pattern (check pattern) formed in the margin area of the recording medium 14), and desirably employs a CCD line sensor. In the inkjet recording apparatus 10 in the present embodiment, the presence and absence of ejection abnormalities in the inkjet heads 48M, 48K, 48C and 48Y are judged on the basis of the reading results of the in-line sensor 82.

<Output Unit>

As shown in FIG. 1, the output unit 70 is arranged subsequently to the fixing process unit 60. The output unit 70 includes an endless conveyance belt 74 wrapped about tensioning rollers 72A and 72B, and an output tray 76, in which the recording medium 14 after the image formation is accommodated.

The recording medium 14 that has undergone the fixing process and output from the fixing process unit 60 is conveyed by the conveyance belt 74 and output to the output tray 76.

<Structure of Inkjet Head>

Figure 2:
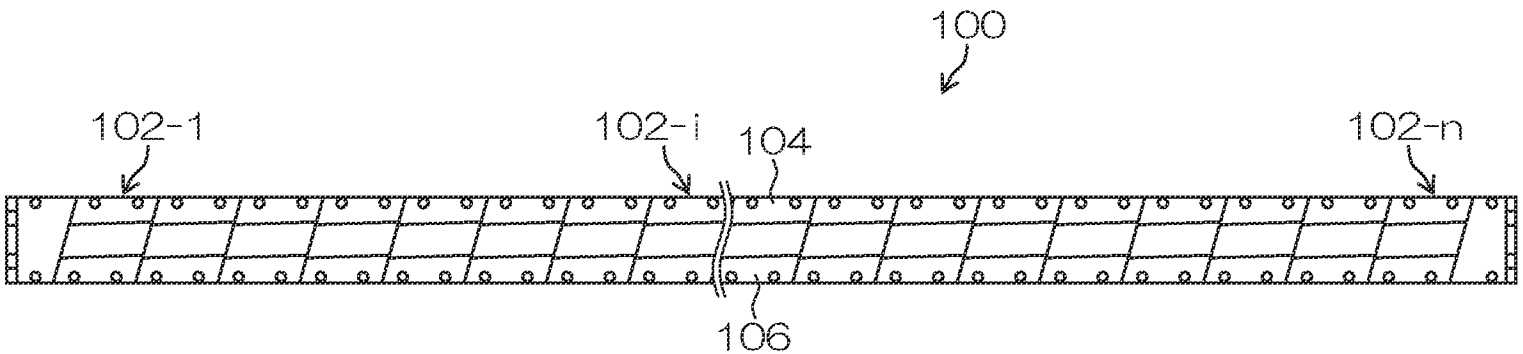
FIG. 2 is a plan view diagram showing a structure of an inkjet head in the inkjet recording apparatus shown in FIG. 1.

FIG. 2 is a general schematic drawing of the inkjet head employed in the present embodiment, which shows a plan view perspective diagram of the head as viewing from the inkjet head toward a recording surface of a recording medium. The inkjet heads 48M, 48K, 48C and 48Y shown in FIG. 1 have the same structure, and therefore in the following description, each of these is referred as the "inkjet head 100" or simply as "head 100", unless there is a need to differentiate between the inkjet heads 48M, 48K, 48C and 48Y.

The head 100 shown in FIG. 2 forms a multi-head by joining together n sub-heads 102-*i* (where i is an integer from 1 to n) in a row. The sub-heads 102-*i* are supported by head covers 104 and 106 from either side of the widthwise direction of the inkjet head 100. It is also possible to constitute a multi-head by arranging sub-heads 102 in a staggered configuration.

One embodiment of the application of the multi-head constituted of the sub-heads is a full-line head, which corresponds to the entire width of a recording medium. The full line head has a structure in which the nozzles 108 (see FIG. 3) are arranged through the dimension (width) of the recording medium in a main scanning direction, following the direction (the main scanning direction X) which is perpendicular to the direction of movement of the recording medium (the sub-scanning direction Y). An image can be formed over the full surface of the recording medium by means of a so-called single-pass image recording method in which image recording is carried out by performing one relative movement action of the head 100 having this structure and the recording medium.

Figure 3:
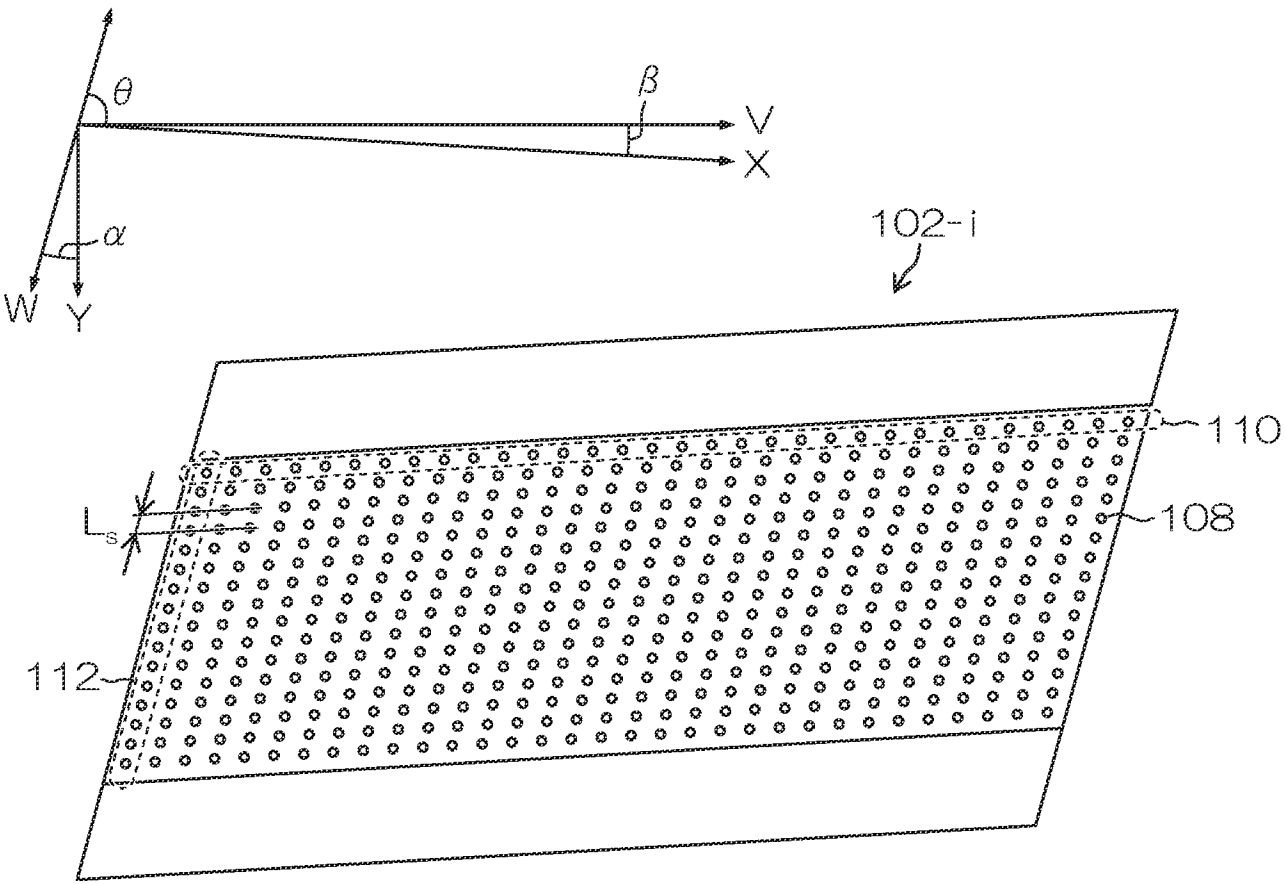
FIG. 3 is a diagram illustrating an arrangement of nozzles in a sub-head shown in FIG. 2.

FIG. 3 is a plan diagram showing the nozzle arrangement in the sub-head 102-*i*. As shown in FIG. 3, each sub-head 102-*i* has a structure in which the nozzles 108 are arranged in a two-dimensional configuration, and the head which includes the sub-heads 102-*i* of this kind is known as a so-called matrix head.

The sub-head 102-*i* shown in FIG. 3 has a structure in which the nozzles 108 are arranged in a column direction W that forms an angle α with respect to the sub-scanning direction Y, and a row direction V that forms an angle β with respect to the main scanning direction X, thereby achieving a high density of the effective nozzle arrangement in the main scanning direction X. In FIG. 3, a nozzle group (nozzle row) arranged in the row direction V is denoted with reference numeral 110, and a nozzle group (nozzle column) arranged in the column direction W is denoted with reference numeral 112.

Figure 4:
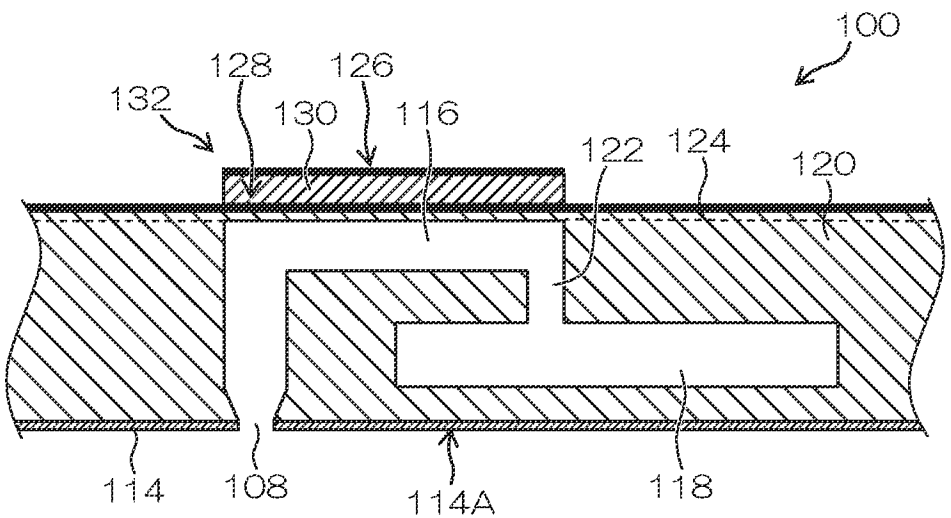
FIG. 4 is a cross-sectional diagram showing an inner structure of the sub-head shown in FIG. 2.

FIG. 4 is a cross-sectional diagram showing an inner structure of a droplet ejection element (an ink chamber unit corresponding to one nozzle 108) corresponding to one channel, which is a unit of recording element. As shown in FIG. 4, the head 100 of the present embodiment has a structure in which a nozzle plate 114 having the nozzles 108 formed thereon and a flow channel plate 120 having pressure chambers 116 and a common flow channel 118 formed therein, are stacked and bonded to each other. The nozzle plate 114 forms the nozzle surface 114A of the head 100. The nozzles 108 which are respectively communicated with the pressure chambers 116 are formed two-dimensionally.

The flow channel plate 120 is a flow channel forming member, which constitutes side walls of the pressure chambers 116 and in which the supply port 122 is formed to serve as a restricting section (the narrowest portion) of an individual supply channel for introducing the ink from the common flow channel 118 to each pressure chamber 116. For the convenience of the description, a simplified view is provided in FIG. 4, but the flow channel plate 120 has a structure formed of a single substrate or a plurality of substrates stacked together.

The nozzle plate 114 and the flow channel plate 120 can be made of silicon and processed into a desired shape by a semiconductor manufacturing process.

The common flow channel 118 is communicated with an ink tank (not shown) that serves as an ink supply source. The ink is supplied from the ink tank to each of the pressure chambers 116 through the common flow channel 118.

A piezoelectric actuator 132 is bonded to a diaphragm 124 that forms a portion of the face of each pressure chamber 116 (a ceiling face in FIG. 4). The piezoelectric actuator 132 has an individual electrode 126 and a lower electrode 128 and has a piezoelectric element 130 placed between the individual electrode 126 and the lower electrode 128. When the diaphragm 124 is constituted of a thin film of a metal or metal oxide, the diaphragm 124 can also function as a common electrode corresponding to the lower electrode 128 of the piezoelectric actuator 132. When the diaphragm 124 is formed of a non-conductive material such as resin, a lower electrode layer made of a conductive material such as metal is formed on a surface of the diaphragm material.

When a drive voltage is applied to the individual electrode 126, the piezoelectric actuator 132 deforms, thus changing the volume of each pressure chamber 116, and the ink is ejected through the nozzle 108 due to the resulting pressure change. When the piezoelectric actuator 132 returns to its original state after the ejection of the ink, the pressure chamber 116 is filled with new ink that is supplied from the common flow channel 118 through the supply port 122.

In the ink chamber unit having the structure shown in FIG. 3, the head having high-density nozzles according to the present embodiment is achieved by arranging the nozzles in a lattice configuration according to a certain arrangement pattern along the row direction V, which forms the angle β with respect to the main scanning direction X, and the column direction W, which forms the angle α with respect to the sub-scanning direction Y. In this matrix arrangement, the nozzles 108 can be regarded as substantially equivalent to those nozzles arranged linearly at a certain pitch $P=Ls/\tan\theta$ along the main scanning direction, where Ls is a distance between the nozzles adjacent in the sub-scanning direction.

A nozzle arrangement that can be applied in the present invention is not limited to the nozzle arrangement shown in FIG. 3. For example, a matrix arrangement of a plurality of nozzles along a row direction following the main scanning direction and a column direction oblique to the main scanning direction can be applied.

<Description of Control System>

Figure 5:
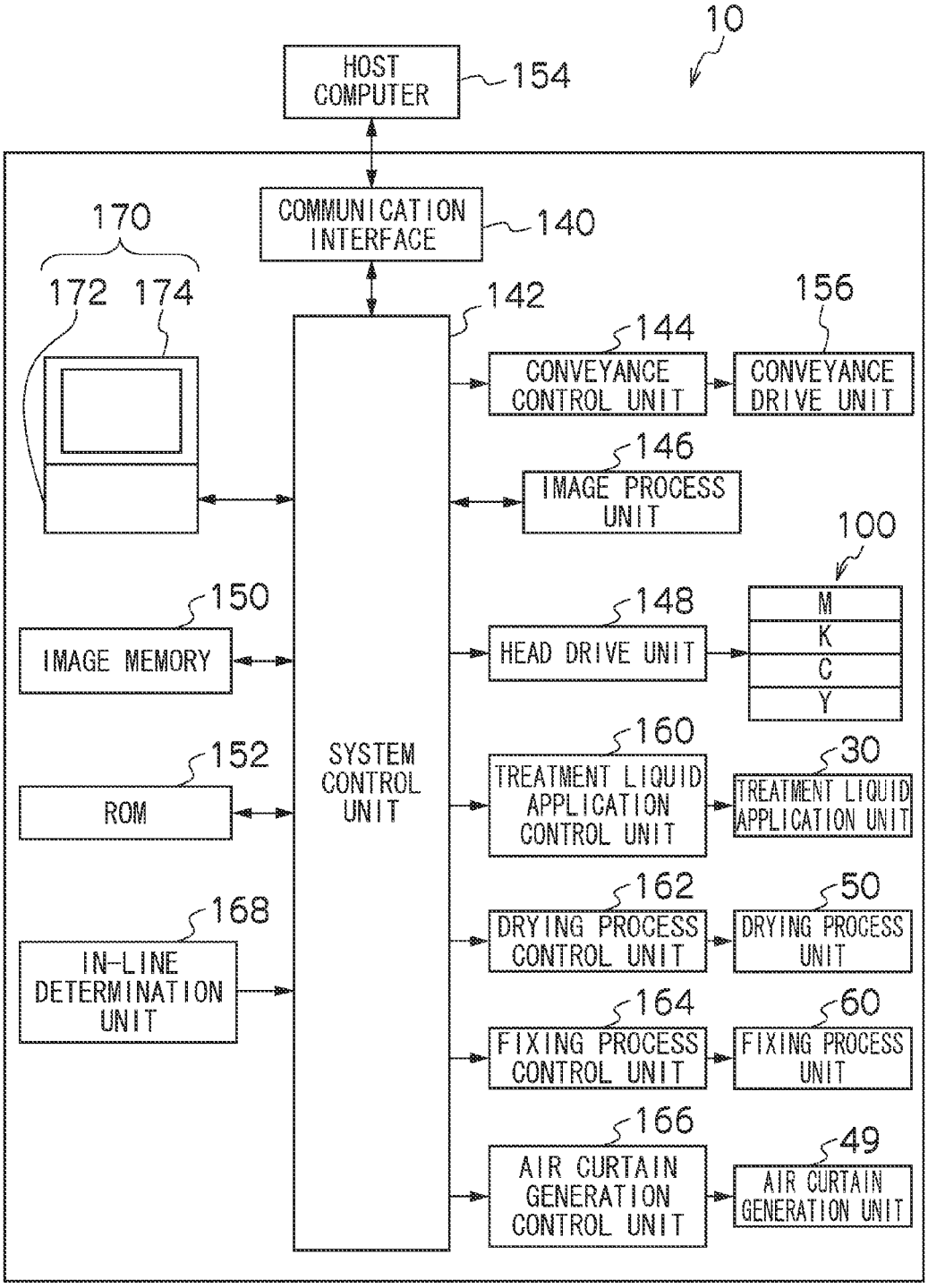
FIG. 5 is a block diagram showing a configuration of a control system of the inkjet recording apparatus shown in FIG. 1.

FIG. 5 is a block diagram showing a system configuration of the inkjet recording apparatus 10. As shown in FIG. 5, the inkjet recording apparatus 10 includes a communication interface 140, a system control unit 142, a conveyance control unit 144, an image process unit 146, a head drive unit 148, an image memory 150, and a ROM 152.

The communication interface 140 is an interface unit for receiving image data sent from a host computer 154. A serial interface such as USB (Universal Serial Bus) or a parallel interface such as a Centronics interface may be used as the communication interface 140. A buffer memory (not shown) may be mounted in the communication interface 140 in order to increase the communication speed.

The system control unit 142 is constituted of a central processing unit (CPU) and peripheral circuits thereof, and functions as a control device for controlling the entire inkjet recording apparatus 10 in accordance with a predetermined program, as well as a calculation device for performing various calculations. The system control unit 142 further functions as a memory controller for controlling the image memory 150 and the ROM 152. In other words, the system control unit 142 controls the communication interface 140, the conveyance control unit 144 and other units to control communication between these units and a host computer 154, controls reading/writing of data to/from the image memory 150 and the ROM 152, and generates control signals for controlling the units described above.

The image data sent from the host computer 154 is received by the inkjet recording apparatus 10 through the communication interface 140, and is temporarily stored in the image memory 150. The image memory 150 is a storage device for storing image data inputted through the communication interface 140, and the data is written and read to and from the image memory 150 through the system control unit 142. The image memory 150 is not limited to a memory composed of semiconductor elements, and a hard disk drive or another magnetic medium may be used.

The conveyance control unit 144 controls conveyance timing and conveyance speed for conveying the recording medium 14 (see FIG. 1) in accordance with a print control signal generated by the image process unit 146. The conveyance drive unit 156 shown in FIG. 5 includes motors for rotating the pressure drums 34, 44, 54 and 64 shown in FIG. 1, motors for rotating the transfer drums 32, 42, 52 and 62, a motor for sending the recording medium 14 in the paper feed unit 20, and a motor for driving the tensioning rollers 72A and 72B of the discharge unit 70. The conveyance control unit 144 functions as a driver for driving these motors.

The image process unit 146 is a control unit that has a signal (image data) processing function for performing various treatment processes/corrections in order to read the image data stored in the image memory 150 and generate the print control signal from the image data, and supplies thus generated print data to the head drive unit 148. The image process unit 146 carries out a required signal process, and the head drive unit 148 controls the droplet ejection amount (droplet deposition amount) and the ejection timing of the droplets ejected by the head 100 in accordance with the image data. As a result, a desired dot size and dot arrangement is realized. The head drive unit 148 shown in FIG. 5 may include a feedback control system for maintaining constant drive conditions in the head 100.

Programs executed by the CPU of the system control unit 142 and various types of data (including data for ink deposition to form a test chart, waveform data for detecting abnormal nozzles, waveform data for recording a formed image, abnormal nozzle information, and the like) which are required for control procedures are stored in the ROM 152. The ROM 152 may be a non-rewritable storage device or a rewritable storage device, such as an EEPROM.

To give a general description of the sequence of processing from image input to print output, image data to be printed (original image data) is inputted from an external source through the communication interface 140, and is accumulated in the image memory 150. At this stage, multiple-value RGB image data is stored in the image memory 150, for example.

In this inkjet recording apparatus 10, an image which appears to have a continuous tonal graduation to the human eye is formed by changing the deposition density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 150 is sent through the system control unit 142 to the image process unit 146, in which the image data is subjected to processing of density data generation, correction and ink ejection data generation, and thereby converted to the dot data for each ink color.

In other words, the image process unit 146 performs processing for converting the input RGB image data into dot data for the four colors of M, K, C and Y. The dot data thus generated by the image process unit 146 is stored in the image buffer memory. The dot data of the respective colors is converted into MKCY droplet ejection data for ejecting ink from the nozzles of the heads 100, thereby establishing the ink ejection data to be printed.

By supplying the drive signals outputted by the head drive unit 148 to the heads 100 in this way, ink is ejected from the corresponding nozzles 108. By controlling ink ejection from the heads 100 in synchronization with the conveyance speed of the recording medium 14, an image is formed on the recording medium 14.

The inkjet recording apparatus 10 further includes a treatment liquid application control unit 160, a drying process control unit 162, a fixing process control unit 164, and an air curtain generation control unit 166, and controls the operations of the treatment liquid application unit 30, the drying process unit 50, the fixing process unit 60, and the air curtain generation unit 49, in accordance with instructions from the system control unit 142.

The treatment liquid application control unit 160 controls treatment liquid application timing and the amount of treatment liquid to be applied, according to the print data acquired from the image process unit 146. The drying process control unit 162 controls drying process timing, the processing temperature, and the amount of air to be blown. The fixing process control unit 164 controls the temperature of the heater 66 of the fixing process unit 60, as well as the pressure of the fixing roller 68.

The air curtain generation control unit 166 controls the operations of the air curtain generation unit 49 arranged between the image formation unit 40 and the drying process unit 50. More specifically, the air curtain generation control unit 166 sends a command to the air curtain generation unit 49 for controlling the rotational speed of a fan motor 226 (see FIG. 7) and thereby controlling a speed of an air flow.

The in-line determination unit 168 is a processing block that includes the in-line sensor 82 shown in FIG. 1 and a signal processing unit that performs predetermined signal processes on a read signal output from the in-line sensor 82, the predetermined signal processes including noise reduction, amplification, and waveform shaping. The system control unit 142 determines the presence/absence of abnormal ejection in the head 100 on the basis of the determination signal obtained from the in-line determination unit 168. The system control unit 142 then stores a result of the determination in a predetermined memory, and sends a command signal to each of the units of the inkjet recording apparatus 10 to execute maintenance on the head 100. The system control unit 142 may be configured to send a notification of a failure in the head 100 or a notification of the maintenance of the head 100.

A user interface 170 includes an input device 172 through which an operator (user) can make various inputs, and a display unit 174. The input device 172 can employ various devices, such as a keyboard, mouse, touch panel, buttons, or the like. The operator is able to enter print conditions, select image quality modes, enter and edit additional information, search for information, and the like, by operating the input device 172, and is able to check various information, such as the input contents, search results, and the like, through a display on the display unit 174. The display unit 174 also functions as a warning notification device which displays a warning message, or the like.

<Description of Air Curtain>

Figure 6:
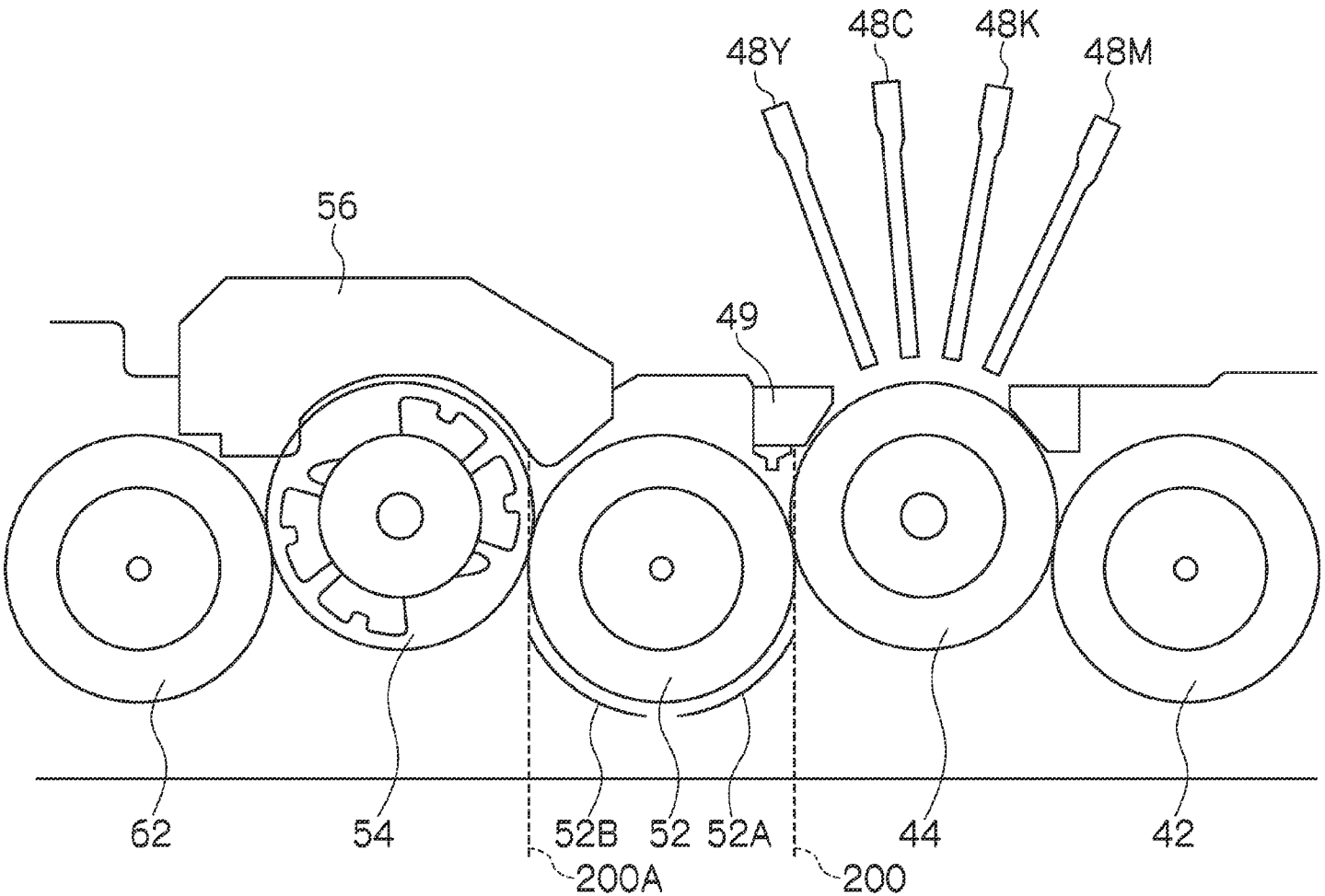
FIG. 6 is an enlarged view of an image formation unit and a drying process unit shown in FIG. 1.

The air curtain arranged between the image formation unit 40 and the drying process unit 50 is described in detail below. FIG. 6 is an enlarged view of the image formation unit 40 and the drying process unit 50 shown in FIG. 1. In FIG. 6, parts which are the same as or similar to the parts described above are denoted with the same reference numerals and further explanation thereof is omitted.

A dashed line 200 between the image formation drum 44 and the transfer drum 52 in FIG. 6 represents the air curtain generated by the air curtain generation unit 49. The air curtain is constituted of an air flow blown in a planar shape in a vertically downward direction or a downward direction oblique to the vertical direction. The air curtain has a predetermined length of the air flow in the flow direction and keeps a constant air flow speed throughout a predetermined width, and thereby fulfills a function equivalent to that of a physical insulation member.

In the drying process unit 50 in the present embodiment, the guide members 52A and 52B arranged under the transfer drum 52 are provided with the built-in heaters, and the drying process is carried out with heat emitted from the guide members 52A and 52B to the recording medium 14 conveyed by the transfer drum 52. Hence, the air curtain generation unit 49 in the present embodiment is arranged above a transfer position between the image formation drum 44 and the transfer drum 52 where the recording medium 14 is transferred, such that the air curtain 200 is formed at a boundary position between the image formation drum 44 and the transfer drum 52 and that the image formation unit 40 is thermally insulated from the heat generated by the heaters installed in the guide members 52A and 52B.

For the structural circumstances of the inkjet recording apparatus 10, the air curtain generation unit 49 in the present embodiment needs to be accommodated within a space approximately 100 mm by 200 mm, above the transfer position between the image formation drum 44 and the transfer drum 52 where the recording medium 14 is transferred. In order to dispose the air curtain generation unit 49 at the space as shown in FIG. 6, the air curtain generation unit 49 is configured to also serve as an ink mist recovery unit for recovering ink mist floating in the image formation unit 40.

If the transfer drum 52 is not used for performing the drying process onto the recording medium 14 on which the image is formed, then it is sufficient to arrange the air curtain 200 at any position between the image formation unit 40 and the drying process unit 50, and the air curtain 200 can be formed anywhere between the transfer position between the image formation drum 44 and the transfer drum 52 where the recording medium 14 is transferred and a transfer position represented with a dashed line 200A between the transfer drum 52 and the drying drum 54 where the recording medium 14 is transferred. According to such aspect, the air curtain generation unit 49 and the ink mist recovery unit may be arranged separately from each other.

Figure 7:
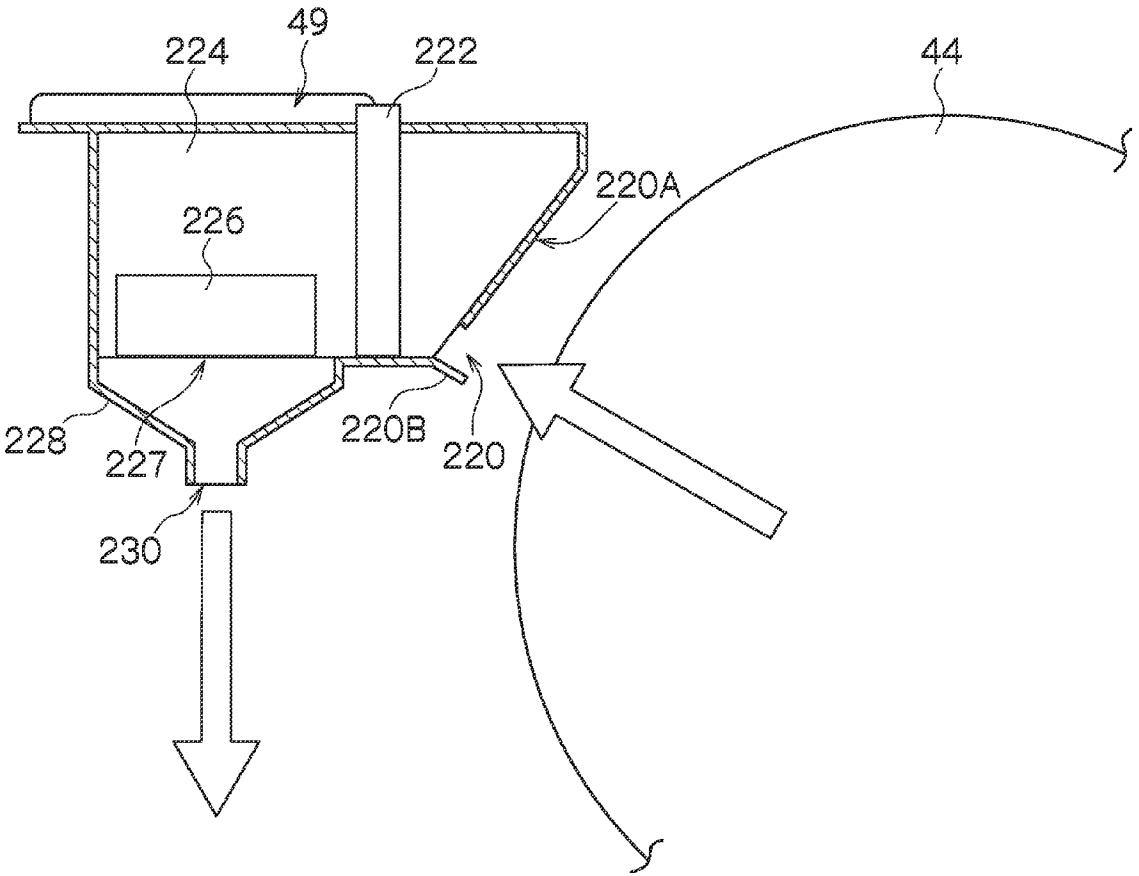
FIG. 7 is a schematic configuration diagram of an air curtain generation unit shown in FIG. 6.
Figure 8:
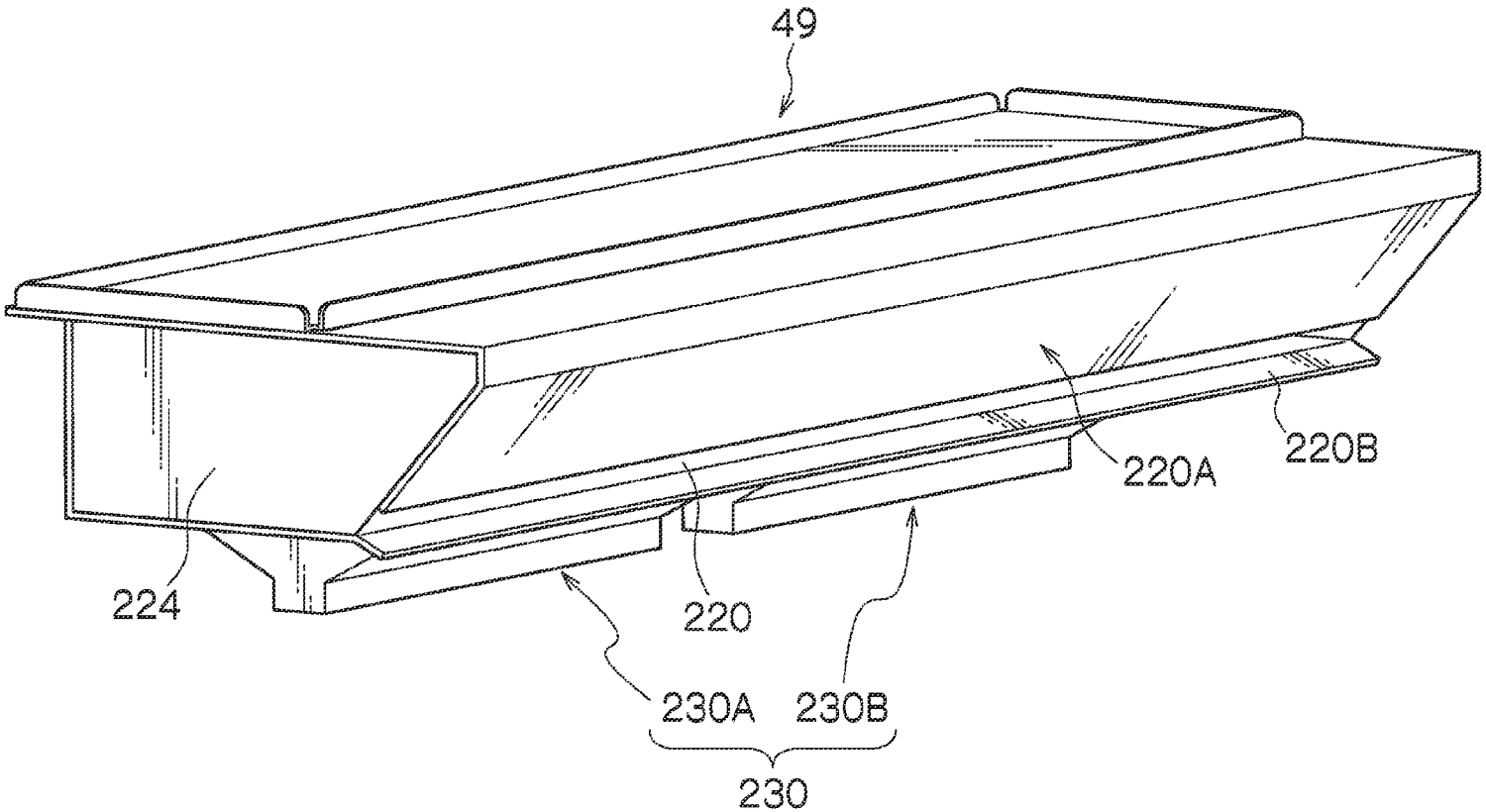
FIG. 8 is a perspective view of the air curtain generation unit shown in FIG. 7.

FIG. 7 is a conceptual diagram showing a schematic configuration of the air curtain generation unit 49 shown in FIG. 6, and FIG. 8 is a perspective view of the air curtain generation unit 49 shown in FIG. 7. As shown in FIG. 7, the air curtain generation unit 49 has: a suction side opening 220, through which air is sucked in an air suction direction indicated with an outlined arrow directed toward the opening 220; a filter 222, which removes foreign matter such as the ink mist from the sucked air; an air storage chamber 224, which stores the air after the foreign matter has been removed therefrom by the filter 222; a fan motor 226, which is arranged on the bottom face of the air storage chamber 224 and discharges the air stored in the air storage chamber 224 in the vertically downward direction or in the downward direction oblique to the vertical direction so as to generate a flow of air flowing in the vertically downward direction or in the downward direction oblique to the vertical direction; an inlet port 227 for the air flow generated by the fan motor 226; a discharge side opening 230, which has a dimension smaller than that of the inlet port 227; and an air restricting unit 228, which restricts the air flow generated by the fan motor 226.

As shown in FIG. 8, in the air curtain generation unit 49, the lengths of the suction side opening 220 and the discharge side opening 230 in the lengthwise direction of the air curtain generation unit 49 are determined in accordance with the lengths of the image formation drum 44 and the transfer drum 52 in their axial directions. In the aspect shown in FIG. 8, the discharge side opening 230 is divided into two parts in the lengthwise direction, thus forming two discharge side openings 230A and 230B, with the substantially central position in the lengthwise direction of the discharge side opening 230 as a boundary. For example, the length of the suction side opening 220 of the air curtain generation unit 49 is 820 mm, and the length of the discharge side opening 230 (the total length of the two discharge side openings 230A and 230B and the boundary part) is 620 mm. These values are merely examples, and may take as large values as possible in accordance with the lengths of the image formation drum 44 and the transfer drum 52 in their axial directions. Because the air curtain generation unit 49 shown in FIG. 8 is disposed in the vicinity of the image formation drum 44, a side face (suction side face) 220A facing the image formation drum 44 is inclined downward to follow the shape of the image formation drum 44, and the suction side opening 220 is opened obliquely downward. A flange portion or louver 220B extending substantially vertical to the suction side opening 220 is arranged under the suction side opening 220 so as to allow the air to easily flow into the suction side opening 220 that is opened obliquely downward. The suction side face 220A may have a partially-cylindrical shape to follow the shape of the image formation drum 44.

The filter 222 has mesh smaller than objects to be captured, such as the ink mist and paper dust. The filter 222 can be constituted of a plurality of filters having mesh in different sizes in accordance with respective objects to be captured.

The air curtain generation unit 49 can be provided with a plurality of fan motors aligned in the lengthwise direction thereof. For example, approximately ten to twelve fan motors having a size of approximately 50 mm by 50 mm can be arranged to correspond to the length of the discharge side opening 230.

The fan motor 226 can be any type of fan motor, provided that the fan motor generates an air flow having an air flow speed enough to generate the air curtain 200. The size of the fan motor 226 is determined appropriately in accordance with the size of the air storage chamber 224 and the dimension of the discharge side opening 230 in the lengthwise direction, which is parallel to the axial direction of the image formation drum 44.

The air curtain generation unit 49 is provided with the air restricting unit 228 to restrict the air flow generated by the fan motor 226 so as to increase the speed of the air flow to be discharged from the discharge side opening 230, to the speed at which the air flow functions as the air curtain. More specifically, the air restricting unit 228 is configured such that a bottom aperture or an outlet through which the air exits (i.e., the discharge side opening 230) has an aperture area smaller than an aperture area of an upper aperture or an inlet through which the air enters (i.e., a plane on which the fan motor 226 is disposed). The air restricting unit 228 in the present embodiment is configured to increase the speed of the air flow generated by the fan motor 226, by approximately threefold.

<Description of Thermal Insulation Effect of Air Curtain>

The thermal insulation effects of the air curtain 200 generated by the above-described air curtain generation unit 49 are described below. The inkjet recording apparatus 10 in the present embodiment needs to keep the surface temperature of the image formation drum 44 lower than 30° C. in order to prevent condensation on the nozzle surfaces 114A (see FIG. 4) of the inkjet heads 48M, 48K, 48C and 48Y. On the other hand, the surface temperature of the drying drum 54 is around 60° C. to 80° C. as a result of the drying process. If the heat of the drying drum 54 having the relatively high surface temperature is transmitted to the image formation drum 44, it can raise the surface temperature of the image formation drum 44 to above 30° C.

In order to thermally insulate the drying process unit 50 and the image formation unit 40 from each other using the air curtain 200, it is necessary to generate the air curtain 200 that is longer than the length between the position of the discharge side opening 230 of the air curtain generation unit 49 and the lowermost position of the transfer drum 52. According to the configuration in the present embodiment, the length of the air curtain 200 in the vertical direction is 400 mm or above.

In order to generate such air curtain 200 having the length of 400 mm or longer in the vertical direction, the air flow speed of the suction side opening 220 is 1.5 m/sec or higher, and the air flow speed of the discharge side opening 230 is 4.5 msec or higher.

Figure 9A:
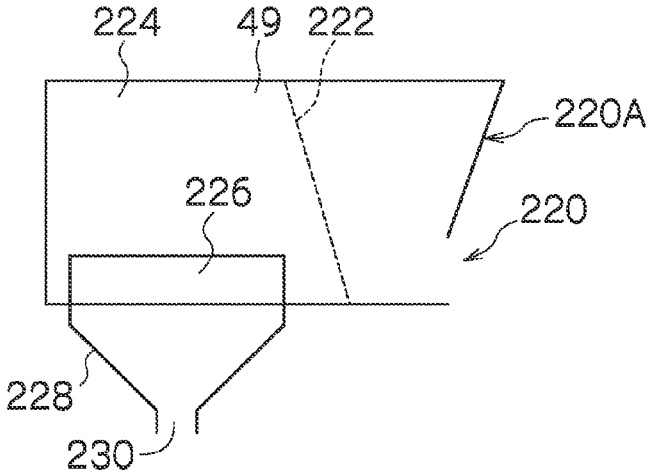
FIGS. 9A, 9B and 9C are conceptual diagrams showing structures used in evaluation experiments on the air curtain generation unit shown in FIGS. 6 and 7.
Figure 9B:
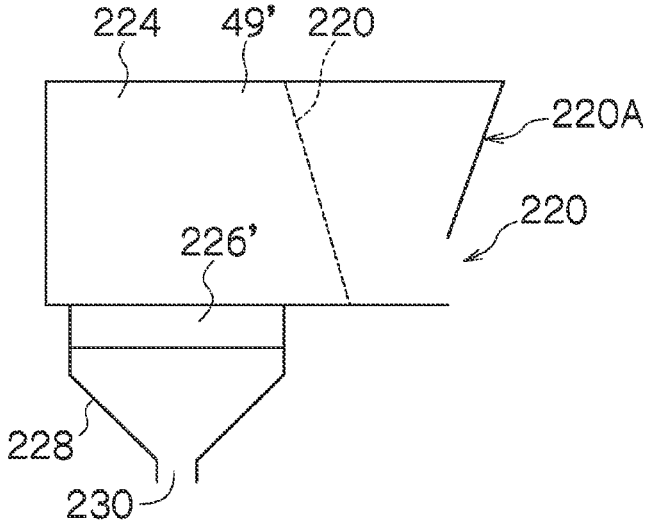
Figure 9C:
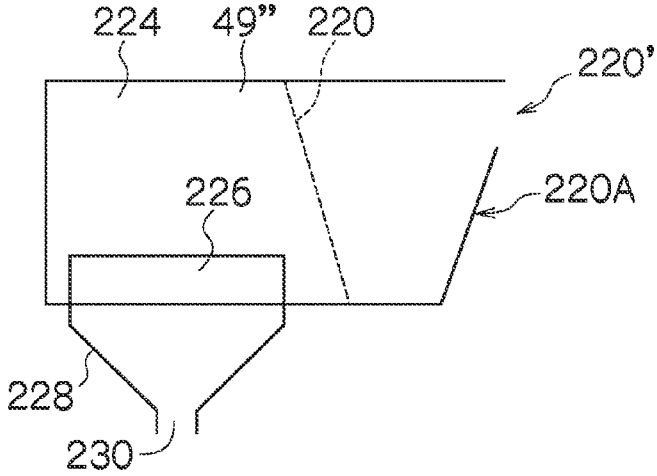

Next is described experiments for evaluating the above-described air flow speed conditions under the conditions such as the breadth of the suction side opening 220 (the dimension in the widthwise direction perpendicular to the lengthwise direction), the position of the suction side opening 220, the breadth of the discharge side opening 230, and the position of the fan motor 226. FIGS. 9A to 9C are conceptual diagrams showing, respectively, schematic structures of air curtain generation units 49, 49' and 49" used in the evaluation experiments. In the air curtain generation unit 49 shown in FIG. 9A, the suction side opening 220 was arranged at the lower end of the suction side face 220A, and the fan motor 226 was arranged within the air storage chamber 224. In the air curtain generation unit 49' shown in FIG. 9B, the suction side opening 220 was arranged at the lower end of the suction side face 220A, and a fan motor 226' was arranged outside the air storage chamber 224. In the air curtain generation unit 49" shown in FIG. 9C, a suction side opening 220' was arranged at an upper end of the suction side face 220A, and the fan motor 226 was arranged within the air storage chamber 224.

The evaluation experiments evaluated whether the above-described conditions were satisfied by the air flow speed at the suction side opening 220 and the air flow speed at the discharge side opening 230 when the conditions such as the breadth of the suction side opening 220, the position for disposing the suction side opening 220, the breadth of the discharge side opening 230, and the position of the fan motor 226 were changed in the air curtain generation units 49, 49' and 49" shown in FIGS. 9A to 9C. The conditions and results of the evaluation experiments are shown in the following Table 1.

TABLE 1

| Experiment No. | Position of suction side opening | Breadth of suction side opening (mm) | Breadth of discharge side opening (mm) | Position of fan motor | Suction side air flow speed (m/s) | Discharge side air flow speed (m/s) | Evaluation |
|---|---|---|---|---|---|---|---|
| 1 | Lower end | 12.5 | 17.0 | Outside | 3.0 | 3.5 | Fair |
| 2 | Lower end | 12.5 | 17.0 | Inside | 3.1 | 3.5 | Fair |
| 3 | Lower end | 20.0 | 17.0 | Inside | 1.7 | 4.2 | Fair |
| 4 | Upper end | 12.5 | 17.0 | Inside | 3.1 | 4.2 | Fair |
| 5 | Upper end | 20.0 | 17.0 | Inside | 2.1 | 4.5 | Good |
| 6 | Lower end | 12.5 | 14.0 | Inside | 2.6 | 4.5 | Good |
| 7 | Lower end | 20.0 | 14.0 | Inside | 2.1 | 4.9 | Good |
| 8 | Upper end | 12.5 | 14.0 | Inside | 2.7 | 5.0 | Good |
| 9 | Upper end | 20.0 | 14.0 | Inside | 1.9 | 5.1 | Good |

The breadth of the discharge side opening 230 was 17 nun in the experiment Nos. 1 to 5, and 14 mm in the experiment Nos. 6 to 9. The experiment No. 1 was a case where the breadth of the suction side opening 220 of the air curtain generation unit 49' shown in FIG. 9B was 12.5 mm. The experiment No. 2 was a case where the breadth of the suction side opening 220 of the air curtain generation unit 49 shown in FIG. 9A was 12.5 mm.

The difference between the experiment Nos. 1 and 2 is whether the fan motor 226 or 226' is located outside or inside of the air storage chamber 224. In the experiment Nos. 1 and 2, although the air flow speed condition at the suction side opening 220 (1.5 m/sec or above) was satisfied in both experiments, the air flow speed condition at the discharge side opening 230 (4.5 in/sec or above) was not satisfied. Because the positions where the fan motors 226 and 226' were disposed made no substantial difference in the air flow speeds at the suction side opening 220 and the discharge side opening 230, the experiments Nos. 3 to 9 used the configuration in which the fan motor 226 was disposed within the air storage chamber 224 as shown in FIG. 9A or 9C.

The experiment No. 3 was a case where the breadth of the suction side opening 220 of the air curtain generation unit 49 shown in FIG. 9A was 20.0 mm. Compared to the experiment No. 2, the air flow speed at the suction side opening 220 was reduced, but the air flow speed condition at the suction side opening 220 was satisfied. On the other hand, at the discharge side opening 230, the air flow speed was increased, but the air flow speed condition was not satisfied.

The experiment Nos. 4 and 5 were cases where the breadth of the suction side opening 220' of the air curtain generation unit 49" shown in FIG. 9C was 12.5 mm and 20.0 mm, respectively. Compared to the experiment No. 2, the air flow speed condition at the suction side opening 220' in the experiment No. 4 was satisfied and the air flow speed at the discharge side opening 230 was increased, but the air flow speed condition at the discharge side opening 230 was not satisfied. In the experiment No. 5, on the other hand, the air flow speed at the suction side opening 220' and the air flow speed at the discharge side opening 230 were higher than those of experiment No. 3, and the air flow speed conditions were satisfied as well.

The experiment Nos. 6 and 7 were cases where the breadth of the suction side opening 220 of the air curtain generation unit 49 shown in FIG. 9A was 12.5 mm and 20.0 mm, respectively. The experiment Nos. 8 and 9 were cases where the breadth of the suction side opening 220' of the air curtain generation unit 49" shown in FIG. 9C was 12.5 mm and 20.0 mm, respectively. The air flow speed conditions at the suction side openings 220 and 220' and the air flow speed condition at the discharge side opening 230 were satisfied in all the experiment Nos. 6 to 9. Although the evaluation results are not shown, the air flow speed condition at the suction side opening 220 cannot be satisfied when forming the entire suction side face 220A as the suction side opening 220 (or 220').

Figure 10:
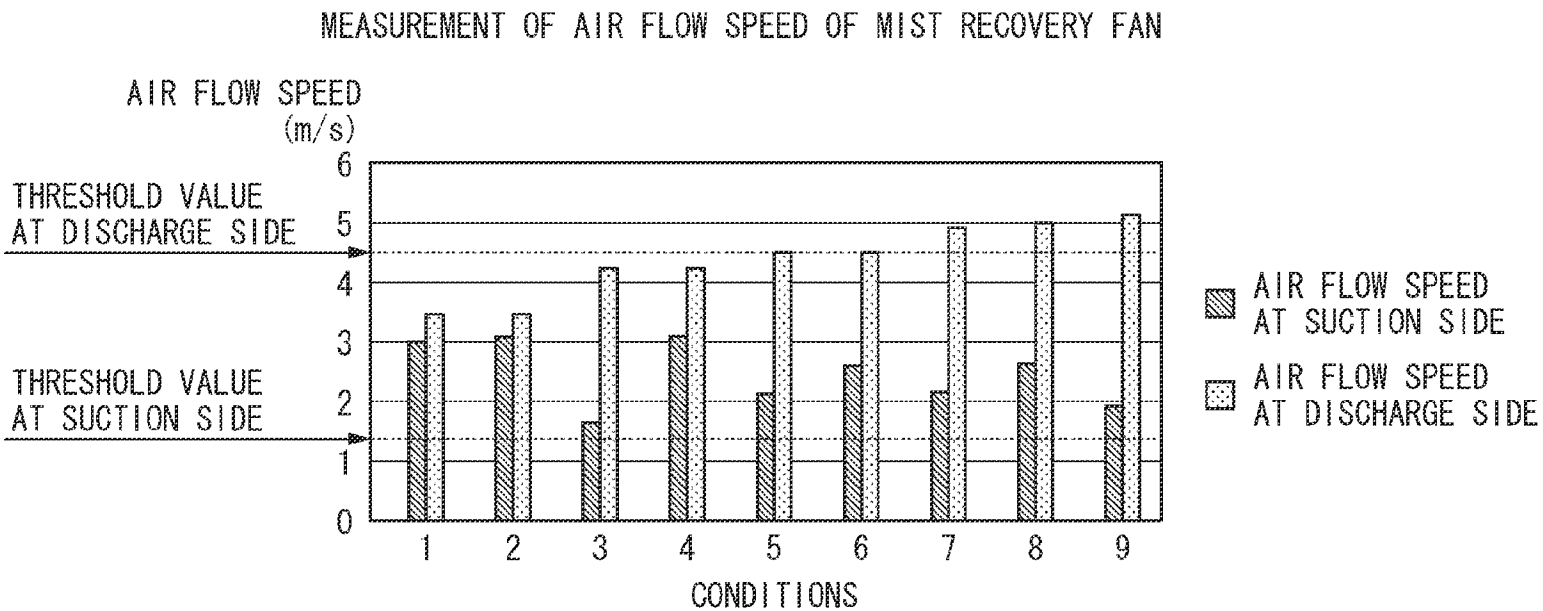
FIG. 10 is a graph showing the results of the evaluation experiments on the air curtain generation unit shown in FIGS. 6 and 7.

FIG. 10 shows the evaluation results shown in Table 1 in the form of bar graphs. As is clear from FIG. 10, in the experiment Nos. 5 to 8, the air flow speed conditions at the suction side opening 220 or 220' (1.5 msec or above) and the air flow speed condition at the discharge side opening 230 (4.5 msec or above) were satisfied.

According to the evaluation results shown in FIGS. 10 and 11, the air flow speeds at the suction side openings 220 and 220' can be increased when the breadths of the suction openings 220 and 220' are set at 12.5 mm (as in the experiment Nos. 2, 4, 6 and 8) instead of 20.0 mm (as in the experiment Nos. 3, 5, 7 and 9). Moreover, compared to the configuration in which the suction side opening 220 shown in FIG. 9A is arranged at the lower end of the suction side face 220A (as in the experiment Nos. 2, 3, 6, 7), the configuration in which the suction side opening 220' shown in FIG. 9C is arranged at the upper end of the suction side face 220A (as in the experiment Nos. 4, 5, 8, 9) can increase the air flow speed at the discharge side opening 230. Furthermore, the air flow speed at the discharge side opening 230 can be increased when the breadth of the discharge side opening 230 is 14 mm (as in the experiment Nos. 6 to 9) instead of 17 mm (as in the experiment Nos. 1 to 5).

In other words, when the breadth of the discharge side opening 230 is 14 mm, the air flow speed condition at the suction side opening 220 (or 220') and the air flow speed condition at the discharge side opening 230 for generating the predetermined air curtain 200 can be satisfied regardless of the conditions such as the position of the suction side opening 220 (or 220') (at the lower or upper end of the suction side face 220A) and the breadth of the suction side opening 220 (or 220') (12.5 mm or 20 mm).

Moreover, when the breadth of the discharge side opening 230 is 17 mm, the air flow speed condition at the suction side opening 220' and the air flow speed condition at the discharge side opening 230 for generating the predetermined air curtain 200 can be satisfied by disposing the suction side opening 220' at the upper end of the suction side face 220A and setting the breadth of the suction side opening 220' at 20 mm.

In summary, the preferred air curtain that satisfies the air flow speed condition at the suction side opening 220 or 220' and the air flow speed condition at the discharge side opening 230 for generating the predetermined air curtain 200 is formed by setting the breadth of the suction side opening 220 or 220' (the dimension of the suction side opening 220 or 220' in the widthwise direction thereof perpendicular to the axial direction of the image formation drum 44) at not shorter than 10 mm and not longer than 30 mm and the breadth of the discharge side opening 230 (the dimension of the discharge side opening 230 in the widthwise direction thereof perpendicular to the axial direction of the image formation drum 44) at not shorter than 10 mm and not longer than 30 mm.

According to the inkjet recording apparatus having the configuration described above, the air curtain generation unit 49 for generating the air curtain 200 is arranged between the image formation unit 40 and the drying process unit 50, so that the image formation unit 40 can be thermally insulated from the heat generated by the process performed in the drying process unit 50. Thus, when improving the efficiency of the drying process by disposing the image formation unit 40 and the drying process unit 50 adjacent to each other, the ambient temperature around the inkjet heads 48M, 48K, 48C and 48Y of the image formation unit 40 can be kept constant, realizing a stable ink droplet ejection operation.

The air curtain 200 has excellent thermal insulating properties, and also serves as an air flow contributing to the drying process for drying the recording medium 14. Moreover, the air curtain 200 also functions to press the recording medium 14 onto the guide members 52A and 52B arranged under the transfer drum 52, when the drying process is performed with the guide members 52A and 52B.

Furthermore, the combination of the air curtain generation unit 49 and the ink mist recovery unit for recovering the ink mist around the image formation unit 40 can not only prevent the increase in size of the entire apparatus because no additional space is required for disposing the air curtain generation unit 49, but also contribute to reduction in power consumption in the entire apparatus.

Because the air curtain generation unit 49 has the fan motor 226 for generating the vertically downward air flow and the air restricting unit 228 for restricting the air flow generated by the fan motor 226, the speed of the air flow generated by the fan motor 226 can be increased, whereby the air curtain 200 having predetermined conditions can be generated.

The present embodiment has been described with respect to the inkjet recording apparatus 10 having the full-line heads in which the nozzles are arranged over the length corresponding to the entire width of the recording medium 14 in the widthwise direction of the recording medium 14; however, the present invention can be applied to an inkjet recording apparatus having a serial scan head.

<Examples of Application to Other Apparatuses>

In the embodiments described above, application to the inkjet recording apparatus for graphic printing has been described, but the scope of application of the present invention is not limited thereto. For example, the present invention can also be applied widely to inkjet systems which obtain various shapes or patterns using liquid functional materials, such as a wire printing apparatus, which forms an image of a wire pattern for an electronic circuit, manufacturing apparatuses for manufacturing various devices, a resist printing apparatus, which uses resin liquid as a functional liquid for ejection, a color filter manufacturing apparatus, a fine structure forming apparatus for forming a fine structure using a material for material deposition, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an image formation unit including: an inkjet head which forms an image on a recording medium; and an image formation drum which has a cylindrical shape, rotates on a central axis or the cylindrical shape serving as a rotational axis while supporting, the recording medium on is circumferential surface of the image formation drum, and thereby moves the recording medium along circumferential direction of the image formation drum relatively to the inkjet head;

a drying process unit including: a drying process device which performs a drying process on the recording medium on which the image has been formed by the inkjet head; and a drying drum which has shape, rotates on a central axis of the cylindrical shape serving as a rotational axis while supporting the recording medium on a circumferential surface of the drying drum, and thereby moves the recording medium along a circumferential direction on of the drying drum in a process region of the drying process unit; and an air curtain generation unit which generates, between the image formation unit and die drying process unit, an air flow in one of a vertically downward direction and a downward direction oblique to a vertical direction, and thereby generates an air curtain for thermal insulation between the image formation unit and the drying process unit, wherein the air curtain generation unit includes:

an air flow generation device which generates the air flow in the one of the vertically downward direction and the downward direction oblique to the vertical direction; and a restricting unit which includes: an inlet through which the air flow generated by the air flow generation device enters the restricting unit; and a discharge side opening through which the air flow exits from the restricting unit to generate the air curtain, the discharge side opening having an aperture area smaller than an aperture area of the inlet, the discharge side opening having a length, in direction parallel to an axial direction of the image formation drum, corresponding to an entire length of the image formation unit in a direction parallel to the axial direction of the image formation drum.

2. The inkjet recording apparatus as defined in claim 1, wherein:

the drying process unit further includes: a transfer drum which transfers the recording medium having the image formed thereon from the image formation drum to the drying drum; and a guide member which is arranged in a proximal position under the transfer drum, supports the recording medium which is being conveyed by the transfer drum, and performs the drying process on the recording medium which is being conveyed by the transfer drum; and the ear curtain generation unit generates the air flow between the image formation unit and the transfer drum.

3. The inkjet recording apparatus as defined in claim 1, wherein:

the drying process unit further includes a transfer drum which transfers the recording medium having the image formed thereon from the image formation drum to the drying drum, and performs the drying process on the recording medium while conveying the recording medium from the image formation drum to the drying drum; and the air curtain generation unit generates the air flow between the image formation unit and the transfer drum.

4. The inkjet recording apparatus as defined in claim 1, wherein the air curtain generation unit further includes:

a suction side opening through which air is sucked into the air curtain generation unit, the suction side opening being arranged on a side face of the air curtain generation unit facing the image formation unit; and a filter which is arranged between the suction side opening and the air flow generation device.

5. The inkjet recording apparatus as defined in claim 4, wherein the suction side opening is arranged at one of an upper end and a lower end of the side face of the air curtain generation unit facing the image formation unit.

6. The inkjet recording apparatus as defined in claim 4, wherein the side face of the air curtain generation unit facing the image formation unit is inclined toward the image formation drum to follow a shape of the image formation drum.

7. The inkjet recording apparatus as defined in claim 4, wherein the air curtain generation unit has a flange portion which protrudes from the suction side opening toward the image formation drum.

8. The inkjet recording apparatus as defined in claim 4, wherein a breadth of the suction side opening in a direction perpendicular to the axial direction of the image formation drum is not shorter than 10 mm and not longer than 30 mm.

9. The inkjet recording apparatus as defined in claim 1, wherein a breadth of the discharge side opening in a direction perpendicular to the axial direction of the image formation drum is not shorter than 10 mm and not longer than 30 mm.

10. A method of thermally insulating an image formation unit and a drying process unit in an inkjet recording apparatus from each other, wherein:

the inkjet recording apparatus comprises:

the image formation unit including: an inkjet head which forms an image on a recording medium; and an image formation drum which has a cylindrical shape, rotates on a central axis of the cylindrical shape serving as a rotational axis while supporting the recording medium on a circumferential surface of the image formation drum, and thereby moves the recording medium along a circumferential direction of the image formation drum relatively to the inkjet head;

the drying process unit including: a drying process device which performs a drying process on the recording medium on which the image has been formed by the inkjet head; and a drying drum which has a cylindrical shape, rotates on a central axis of the cylindrical shape serving as a rotational axis while supporting the recording medium on a circumferential surface of the drying drum, and thereby moves the recording medium along a circumferential direction of the drying drum in a process region of the drying process unit, and the method comprises the steps of:

generating an air flow;

having the air flow generated in the air flow generating step flow between the image formation unit and the drying process unit in one of a vertically downward direction and a downward direction oblique to the vertical direction, by having the air flow generated in the air flow generating step enter into a restricting unit through an inlet of the restricting unit and exit from the restricting unit through a discharge side opening of the restricting unit, the discharge side opening having an aperture area smaller than an aperture area of the inlet, the discharge side corresponding to an entire length of the image formation unit in a direction parallel to the axial thereby generating an air curtain for thermal insulation between the image formation unit and die drying process unit.

* * * * *